US006722559B1

(12) United States Patent
Millar et al.

(10) Patent No.: US 6,722,559 B1
(45) Date of Patent: Apr. 20, 2004

(54) APPARATUS AND METHOD FOR MITIGATING WEAR IN DOWNHOLE TOOLS

(75) Inventors: Ian Millar, Aberdeen (GB); Suresh Patel, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/647,336

(22) PCT Filed: Jan. 28, 2000

(86) PCT No.: PCT/GB00/00234

§ 371 (c)(1),
(2), (4) Date: Sep. 29, 2000

(87) PCT Pub. No.: WO00/45025

PCT Pub. Date: Aug. 3, 2000

(30) Foreign Application Priority Data

Jan. 30, 1999 (GB) ..... 9901992

(51) Int. Cl.[7] ..... B23K 35/22
(52) U.S. Cl. ..... 228/256; 51/295
(58) Field of Search ..... 228/256, 119, 228/248.1, 245; 651/295, 296; 427/580, 587

(56) References Cited

U.S. PATENT DOCUMENTS

| | | | | |
|---|---|---|---|---|
| 3,650,714 A | | 3/1972 | Farkas | |
| 4,171,387 A | * | 10/1979 | Fogle et al. | |
| 4,396,077 A | | 8/1983 | Radtke | 175/329 |
| 4,610,320 A | | 9/1986 | Beakley | |
| 4,621,031 A | * | 11/1986 | Scruggs | 148/403 |
| 4,781,770 A | | 11/1988 | Kar | |
| 4,855,002 A | * | 8/1989 | Dunn et al. | 156/307.3 |
| 5,049,165 A | * | 9/1991 | Tselesin | 51/295 |
| 5,376,444 A | * | 12/1994 | Grotepass et al. | 428/336 |
| 5,755,299 A | * | 5/1998 | Langford et al. | 175/375 |
| 5,956,845 A | * | 9/1999 | Arnold | |
| 5,980,678 A | * | 11/1999 | Tselesin | 156/230 |
| 6,009,962 A | | 1/2000 | Beaton | |
| 6,110,240 A | * | 8/2000 | Saguchi et al. | 205/674 |
| 6,227,188 B1 | * | 5/2001 | Tankala et al. | 125/13.01 |
| 6,365,230 B1 | * | 4/2002 | Baik et al. | 427/249.11 |

FOREIGN PATENT DOCUMENTS

| | | |
|---|---|---|
| EP | 0086086 A | 8/1983 |
| EP | 0086086 A2 | 8/1983 |
| EP | 0822318 A1 | 2/1998 |
| EP | 0822318 A | 2/1998 |
| GB | 2288351 A | 1/1995 |
| GB | 2288351 A | 10/1995 |

* cited by examiner

*Primary Examiner*—Tom Dunn
*Assistant Examiner*—Jonathan Johnson
(74) *Attorney, Agent, or Firm*—Moser, Patterson & Sheridan, L.L.P.

(57) ABSTRACT

Surfaces of a downhole tool, e.g. a drill bit, a reamer shoe or a stabilizer, are protected by at least temporarily fixing a super-hard material (6) to the surfaces of the down-hole tool, and spray fusing a binding material (2) around the super-hard material to permanently bind the super-hard material to the down hole tool.

8 Claims, 1 Drawing Sheet

FIG. 1
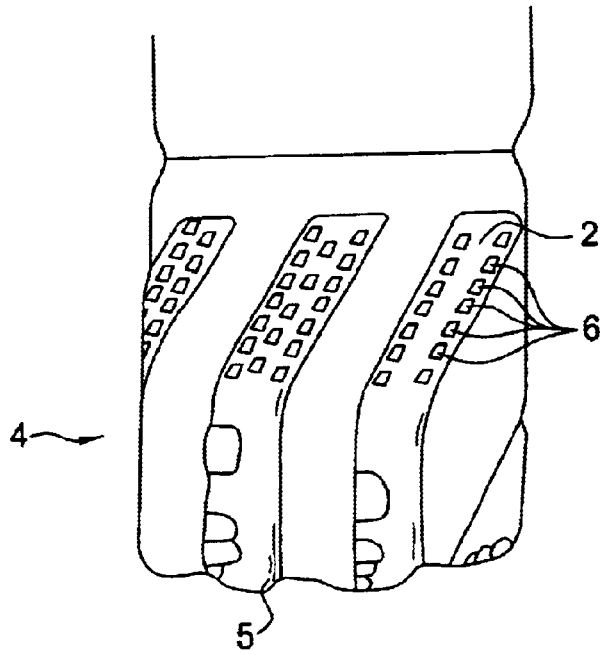
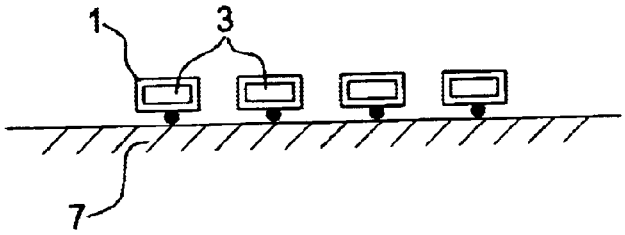
FIG. 2
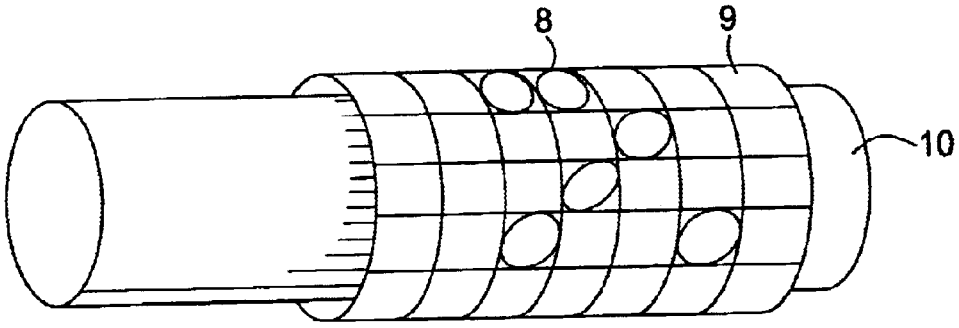
FIG. 3

APPARATUS AND METHOD FOR MITIGATING WEAR IN DOWNHOLE TOOLS

The present invention is in the field of downhole tools and particularly relates to apparatus for protecting areas of such tools from abrasion, erosion or wear.

An example where the protection of a downhole tool from such defeating is important is the gauge of a drill bit. Drill bit crowns (or drill heads) typically comprise an end face with a cutting structure and a gauge behind the cutting structure. The purpose of the gauge area on a drill bit is to support the bit in the bore hole, previously drilled by the cutting structure on the end face of the crown. This serves to keep the drill bit crown concentric to the bore hole axis and maintains stability, thereby preventing resonant vibrations and other complex motion.

It will be appreciated by those skilled in the art that in the event that the gauge of the drill head becomes deformed or otherwise defaced through wear or abrasion, the integrity of the bore hole is diminished. Clearly it is important for a drill bit to retain its shape if the tool string to which it is attached is to be operated successfully.

Other down-hole equipment, such as stabilisers and casing centralisers also become far less effective if they are deformed or otherwise defaced. As the dimensional integrity of a stabiliser is diminished it is less able to control the steerability of a downhole tool string.

An object of the present invention is therefore to provide a means for strengthening or hardening areas of downhole tools or other apparatus in order to increase their resistance against abrasion, erosion or wear.

In the past drill bits are most commonly protected by reinforcing the gauge. This is usually done by impregnating the drill bit with a relatively hard material that supports the external structure of the gauge. Such materials, for descriptive purposes, may be classified into "hard" and "super hard" materials. Hard materials comprise materials such as tungsten carbide, while thermally stable product (TSP) and natural diamond provide examples of super hard materials.

These strengthening materials are generally not used to form the structure of the down hole component, being difficult to machine and expensive. It is therefore desirable to impregnate the surface of an existing down-hole structure with the hard or super hard materials. In the case of hard materials, this can be achieved by welding particles of the hard material on to the surface of the down hole apparatus and then spray fusing a binding material around the particles. Subsequent grinding or other material removal operations then enable the gauge or other surface area to be finished to specified dimensions.

However, this process has not been considered as appropriate in the past in respect of super hard materials, owing to the general rule that super-hard materials are not electrical conductors and therefore not suited to spot welding.

Not only are super hard materials advantageous in view of their additional hardness, but they also tend to be superior in respect of their tolerance to the hot temperatures encountered down-hole. Yet, although super hard materials are clearly more desirable for use in protecting down-hole surfaces from wear than are hard materials, conventionally it is necessary to braze in the super hard components. This is both time consuming and expensive.

It is therefore recognised in the present invention that it would be desirable to strengthen the surfaces of down-hole components with TSP or other super hard materials using a technique other than brazing.

In order to achieve a solution in response to this recognition, an object of the present invention is to identify a means for holding super hard materials to a surface of a down hole tool temporarily while a more permanent securing or anchoring means is applied.

A yet further object of the present invention is to provide a method for holding the super hard material onto the area to be protected prior to the application of a binder material. Preferably this would be achieved in a manner that allows for a specific pattern of location for the super hard material; the pattern being maintainable during the subsequent binder process.

According to the present invention, there is provided a method for protecting the surfaces of down-hole tools and drilling apparatus, the method comprising the steps of:

a) fixing a super hard material to the surface of the down-hole tool at least temporarily prior to spray fusing; and b) Spray fusing a binding material around the super-hard material in order to provide a permanent binding medium for the super hard material to the surface of the tool.

Preferably the super hard material is affixed to the surface of the down-hole tool using a high temperature adhesive.

Preferably the high temperature adhesive is applied to the super hard material by the use of a syringe.

Alternatively, the super hard material is bathed in the high temperature adhesive prior to affixing said super hard material to the downhole tool surface.

Alternatively, the high temperature adhesive is brushed onto the surface of the down hole tool.

Preferably the high temperature adhesive is alumina based.

Preferably the high temperature adhesive has the consistency of a paint or paste.

Preferably the high temperature adhesive is a curing adhesive.

The super hard material may also be held within a mesh framework, wherein the framework is fixed to the surface of the downhole tool using a high temperature adhesive.

Alternatively, the super hard material is affixed to the surface of the down hole tool by welding, wherein the super hard material is combined with an electrically conductive component to facilitate welding.

Typically the welding of the electrically conductive component will be spot welding using electrical resistance techniques well known to persons skilled in the art.

The electrically conductive component may be a coating on the super hard material. It may for example comprise of a nickel, copper or chromium based alloy that is applied to the super hard material by electroplating.

Alternatively, the electrically conductive component may be a metallic substrate having locating means for holding the super hard material in place during the spray fusing process. Yet further, the electrically conductive component may be a metal framework, preferably in mesh form. The framework may similarly be used to locate small cubes or other shaped particles of the super hard material until such are permanently anchored by means of the application of the surrounding binder material.

The invention is not limited to the order in which the super hard material is fixed to the down hole tool. That is to say, where the electrically conductive component is a metallic substrate or framework for example, the substrate or framework may be affixed to the surface of the tool prior to the attachment thereto (or location therewith) of the super hard material. Alternatively, the substrate may be combined with the super hard material before the substrate is attached to the tool surface.

The down hole tool may be drill bit, reamer shoe or stabiliser or similar device used in applications inside bore holes. Generally, the invention finds application in relation to any down hole tool having a metallic surface that is prone to wear, abrasion or erosion.

The super hard material may be thermally stable product, polycrystalline diamond composite or natural diamond. Other super hard materials will be known or may become known to those skilled in the art and may also find application in respect of this invention.

According to a second aspect of the present invention there is provided a down hole tool having at least part of its surface being toughened against wear or other attack by the inclusion of a super hard material.

Preferably the super hard material is thermally stable product (TSP).

Typically, the down hole tool will be a drill bit.

In order to provide a better understanding of the invention, embodiments of the invention will now be described by way of example only, with reference to the accompanying figures in which:

FIG. 1 illustrates a drill bit, strengthened by super hard material affixed to the drill bit surface by a high temperature adhesive;

FIG. 2 illustrates the TSP provided with a electrically conductive coating and thereafter welded to a drill bit; and FIG. 3 illustrates a super hard material located in a framework that is fixed to a surface of a down-hole tool.

In FIG. 1 a drill bit is generally depicted at 4 comprising a gauge 5 that has a surface strengthened by a super hard material 6. The super hard material is provided as TSP in the form of small cubes that are held in place in a coating of binder material 2. In alternative embodiments other super hard materials may be used and shapes other than cubes (such as spheres) can equally be employed.

The TSP is initially secured onto the surface of the drill bit using a high temperature adhesive. Typically the high temperature adhesive is an alumina based adhesive which is applied to the cubes of TSP in the form of a 'paint' which is syringed onto the cubes. The TSP cubes may also be bathed in the adhesive 'paint' and then fixed to the drill bit surface, or the drill bit surface may itself be coated with the adhesive prior to affixing the TSP. This temporarily holds the TSP in place on the drill bit prior to spray fusing. Spray fusing is carried out with a binder material to permanently anchor the TSP to the bit surface.

FIG. 2 illustrates an alternative embodiment of the present invention wherein a super hard material 3 coated with an electrical conductor 1. The coating 1 allows the super hard material that would otherwise be an electrical insulator to be welded by electrical resistance welding to the surface of a down-hole tool 7.

In FIG. 3 small shaped particles 8 of super hard material are located in a mesh framework 9. The framework can be fixed to the drill bit surface using the high temperature adhesive described above. Alternatively, the framework 9 is made of a suitable alloy that allows it to be readily spot welded to the surface of a down-hole tool 10. In the drawing, the particles 8 are not shown as having an applied coating, but are simply held in location in the mesh 9 by the aid of a corresponding geometry to the mesh spaces. It should be appreciated however, that it is also possible, and may in fact be desirable to coat the super hard material with an electrical conductor so that it may be more securely fixed to the framework during the relatively vigorous process of spray fusing on the binder material.

An advantage of the mesh frame is that it provides a means for ensuring suitable spacing of the super hard material particles.

In a further embodiment not shown, a frame work or the like may be placed over the top or on the outside of the super hard material and then removed after spray fusing has taken place.

An advantage of the present invention is that the use of the super hard material provides gauge or other surface protection due to its greater density and consistency of size and shape. Accordingly, the incidence of tracking between the sections of hard material is reduced, resulting in a longer working life for the device.

Furthermore, as a result of being able to impregnate down hole tool surfaces in a flexible and versatile manner as herein described, it is possible to strengthen a wide range of shapes of tool cross-sections and surfaces. Spray fusing is also more efficient than brazing inserts onto a gauge pad.

Further modifications and improvements may be made without departing from the scope of the invention herein intended.

What is claimed is:

1. A method for protecting a tool for drilling a well bore, comprising:

coating a super hard material with an electrically conductive material; and attaching the super hard material to a surface of the tool by resistance welding the super hard material coated with the electrically conductive material to the surface of the tool.

2. The method of claim 1, wherein the electrically conductive material is a framework configured to hold the super hard material on the surface of the tool.

3. The method of claim 2, wherein the framework is attached to the surface of the tool by a high temperature adhesive.

4. A method as claimed in claim 3 wherein the high temperature adhesive is alumina based.

5. A method as claimed in claim 3 wherein the high temperature adhesive has the consistency of a paint or paste.

6. A method as claimed in claim 2, wherein the framework is mechanically or chemically fixed to the surface.

7. A method as claimed in claim 1, wherein the super hard material is one of a thermally stable product (TSP), natural diamond or polycrystalline diamond composite.

8. A method as claimed in claim 2, wherein the super hard material is one of a thermally stable product (TSP), natural diamond or polycrystalline diamond composite.

* * * * *